US005085574A

United States Patent [19]

Wilson

[11] Patent Number: 5,085,574

[45] Date of Patent: Feb. 4, 1992

[54] FAIL-SAFE VALVE RELAY DRIVER CIRCUIT FOR GAS BURNERS

[75] Inventor: Larry E. Wilson, Marion, Ind.

[73] Assignee: Hamilton Standard Controls, Inc., Farmington, Conn.

[21] Appl. No.: 420,203

[22] Filed: Oct. 12, 1989

[51] Int. Cl.[5] ..... F23N 5/20

[52] U.S. Cl. ..... 431/6; 431/72; 126/39 N; 251/129.01; 251/129.02; 251/129.04

[58] Field of Search ..... 431/6, 72; 126/59 BA, 126/39 E, 39 G, 39 N, 52, 374; 251/129.01, 129.05, 129.02, 129.04

[56] References Cited

U.S. PATENT DOCUMENTS

| | | | |
|---|---|---|---|
| 3,902,839 | 9/1975 | Matthews | 431/25 X |
| 3,986,814 | 10/1976 | De Méré | 431/72 |
| 4,034,235 | 7/1977 | Wade | 307/117 |
| 4,413,303 | 11/1983 | Cheary et al. | 431/25 X |
| 4,828,484 | 5/1985 | Youtz | 431/24 |
| 4,836,770 | 6/1989 | Geary | 431/46 |
| 4,842,510 | 6/1989 | Grunden et al. | 431/19 |
| 4,865,538 | 9/1989 | Scheele et al. | 431/18 |
| 4,872,828 | 10/1989 | Mierzwinski et al. | 431/16 |

*Primary Examiner*—Larry Jones

[57] ABSTRACT

A fail-safe gas valve driver circuit controlling the gas supply line of a gas burner, which circuit in its essential circuit elements (FIG. 1) includes an appropriate switching means (S1) effectively feeding a pulsed DC wave form into the rest of the valve relay driver circuit, operatively consisting only of a capacitor (C1) in series with a gas valve relay (K1), which in turn is in parallel with a diode (D1). In operation, the valve relay coil is energized by charging the capacitor with the switch connected to a positive DC voltage source ($V_{dc}$; FIG. 1A), and then grounding the positive end of the capacitor (switch connected to ground) applying a negative voltage across the coil of the relay (FIG. 1B). When the capacitor is again connected to the positive DC voltage source by the switch, the current in the relay coil is sustained by the diode (FIG. 1C). The switch is operated at a sufficiently high rate so the current in the relay coil has insufficient time to decay significantly during the charging cycle of the capacitor before being replenished during the capacitor discharge cycle. With this circuitry the gas supply valve (G.V.) will always go to, or be maintained in, a closed position, regardless of what component(s) of the valve relay driver circuit might fail or deteriorate. Any inadvertent supply of gas to the burner due to any component failure is avoided without any component redundancy. Two exemplary, transistor switching circuits are described (FIGS. 2 & 3).

6 Claims, 1 Drawing Sheet

FAIL-SAFE VALVE RELAY DRIVER CIRCUIT FOR GAS BURNERS

TECHNICAL FIELD

The present invention relates to gas burners in which the flow of gas to the burner is controlled by an electrically controlled valve, with the control to the valve being achieved with the use of a relay. An exemplary application thereof is a gas-fired furnace. The present invention is more particularly directed to a "fail-safe" type driver circuit for the gas valve relay.

BACKGROUND ART

Gas ignition products are well known and needed types of product. In such products typically an electrically controlled relay controls the opening of a valve in the gas line, which supplies gas to the gas burner. When it is desired to supply gas to the burner, the relay is actuated, opening the valve.

As a standard safety feature, the power supply to the valve relay driver circuit typically will include a power line which remains "on" only when a flame is present in the gas burner. This is to insure that gas does not flow to the burner when no flame is present.

However, in spite of this safeguard, in prior valve relay driver circuits, the failure or deterioration of at least one or more of some of the components in the driver circuit could result in the valve being inadvertently activated and opened, even when there was no burner flame.

Thus, one of the most critical elements of such a gas burner is the electrical circuit controlling the gas valve relay, which, as noted above, in turn controls the flow of gas to the burner. This circuit must never allow the relay to inadvertently pull in, which would open or maintain the gas valve open, due to a component failure, or else un-ignited gas might flow out of the system, causing a great safety hazard.

To achieve the level of safety required by the American Gas Association (AGA) and/or the manufacturer's guidelines, redundant circuits have often been required However, in the competitive environment of original equipment manufacturer (OEM) controls, the lowest cost is essential and yet redundancy is relatively expensive. Additionally, the level of redundancy is often difficult to predict, and the confidence in a new design's safety is always questionable if redundancy is the chief means of achieving safety.

To avoid these problems, the best method of achieving complete safety is for any failure of a component of the valve relay driver circuit to cause the driver circuit itself to become totally inoperable insofar as the valve relay is concerned, and that is the approach achieved in the present invention.

For general background information on gas burners and related circuitry and a gas-fired application thereof, reference is had to the following patents (there of course being many other patents relevant to the arts of relay controlled gas burners and gas-fired furnaces):

| Patent No. | Patentee(s) | Issue Date |
|---|---|---|
| 4,034,235 | Wade | July 5, 1977 |
| 4,865,538 | Scheele et al | Sept. 12, 1989 |

The Scheele et al patent, although having a different inventorship, is owned by the assignee hereof, and is not necessarily "prior art" to the present invention. Its disclosure, as well as the disclosures of the other of assignee's applications listed therein (Serial Nos. 095,508 & 095,506 both filed Sept. 10, 1987, being issued as U.S. Pat. No. 4,872,826 on Oct. 10, 1989 and U.S. Pat. No. 4,842,510 on June 27, 1989, respectively) are incorporated herein by reference.

DISCLOSURE OF INVENTION

The fail-safe valve driver circuit of the present invention utilizes a very simple circuit designed to become inoperable upon failure of any component, regardless of whether the failure is a short circuit, an open circuit, component drift, or component leakage. In addition, a minimum number of parts are used to accomplish this function, resulting in a very economical system.

To achieve this, the essential elements of the driver circuit include an appropriate switch means feeding a pulsed DC wave form into the valve relay driver circuit, which includes a capacitive element in series with a sub-circuit including the valve relay in parallel with a current direction limiting device, such as a diode.

In operation, the coil of the relay is energized by charging the capacitor with the switch connected to a positive DC voltage source, and then grounding the positive end of the capacitor (switch connected to ground) applying a negative voltage across the coil of the relay. When the capacitor is again connected to the positive DC voltage source by the switch, the current in the relay coil is sustained by the diode.

If the switch is then operated at a sufficiently high rate, then the current in the relay coil will not have enough time to decay significantly during the charging cycle of the capacitor before being replenished during the discharge cycle of the capacitor.

With this circuitry and its operation, the gas supply valve will always go to, or be maintained in, a closed position, regardless of what component(s) of the valve relay driver circuit might fail or deteriorate. Thus, any inadvertent supply of gas to the burner due to any component failure is avoided, all without any component redundancy being used.

Thus, it is a basic object of the present invention to achieve a fail-safe type gas valve relay driver circuit which does not rely on redundancy for its "fail-safe"-features.

It is an additional, basic object of the present invention to achieve this type of fail-safe feature with the use of a very simple, economical circuit.

Other features and advantages will be apparent from the specification and claims and from the accompanying drawings, which illustrate at least one exemplary embodiment of the invention.

BEST MODES FOR CARRYING OUT THE INVENTION

ESSENTIAL CIRCUIT ELEMENTS (FIG. 1)

Figure 1:
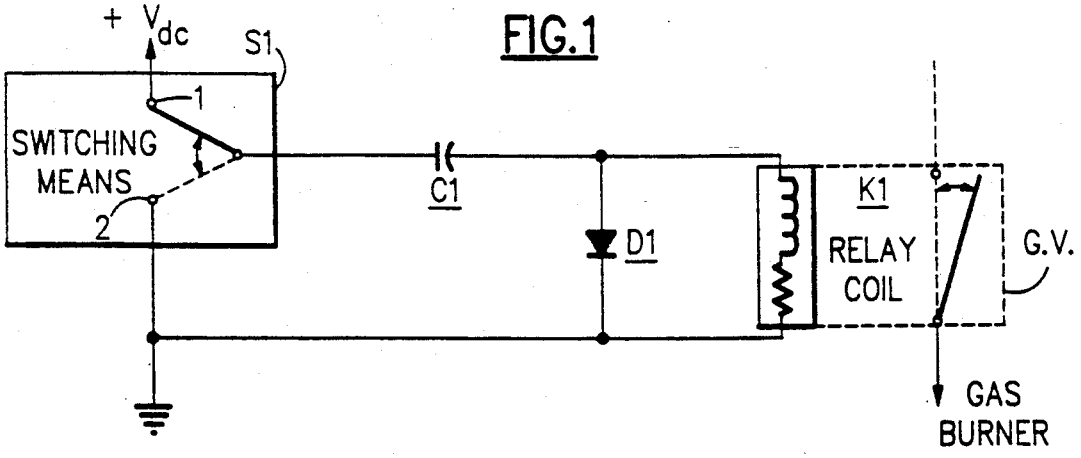
FIG. 1 is a schematic circuit diagram showing the essential circuit elements of the exemplary, generalized embodiment of the fail-safe valve driver circuit of the present invention, including a generalized "switch"element, along with the driver circuit's associated capacitor, diode and relay coil.

As can be seen in FIG. 1, a generalized switch S1 connected across a positive voltage power source $V_{dc}$ to a reference level or point, e.g. "ground," has two switch positions A first position "1"(as shown) feeds a positive voltage to the remainder of the driver circuit, while the second position "2" effectively closes the rest of the circuit with a zero voltage input. The switch S1 typically functions as a pulsed DC source, typically of square wave form.

Figure 1A:
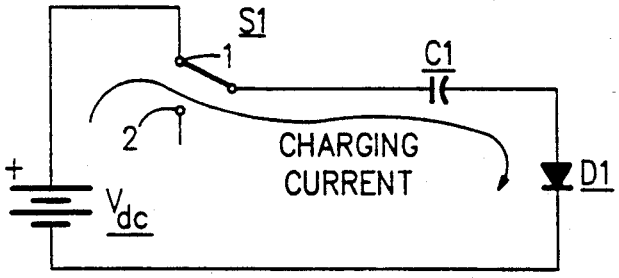
FIGS. 1A, 1B and 1C are schematic circuit diagrams of the then operative portions only of the circuit of FIG. 1 illustrating the various flows of current in the circuit, first as the switch is initially closed to its position "1"(charging the capacitor); and then with the switch in its position "2"
with the capacitor discharging relay pulling, and
subsequently with sustaining current flowing from the relay coil; respectively.
Figure 1B:
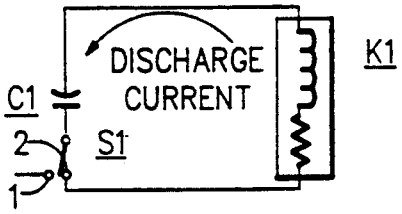

The coil of the valve relay K1 is energized by charging the capacitor C1 with the switch S1 connected to the positive DC voltage source (switch position 1; note FIG. 1A); and then, in the next switch cycle, grounding the positive end of the capacitor C1 (switch position 2; switch connected to ground), applying a negative voltage across the coil (note FIG. 1B).

Figure 1C:
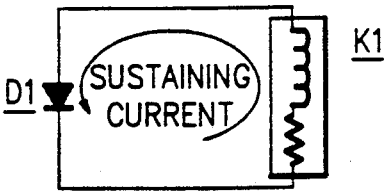

When the capacitor C1 is again connected to the positive voltage source (switch position 1), the current in relay coil K1 is then sustained by diode D1. Note FIG. 1C.

If the switch S1 is then operated back-and-forth at a sufficiently high rate, then the current in relay coil K1 will not have enough time to decay significantly during the charging cycle of the capacitor C1, before being replenished during the discharge cycle of the capacitor. As will be seen in connection with FIGS. 2 & 3, a driver signal, typically microprocessor driven, having a sufficiently high "switch" rate is used with appropriate circuitry to ensure that the switch S1 is effectively operated back-and-forth at a sufficiently high rate so that the current in the coil will not significantly decay.

This action or operation is a very important part of the present invention.

With respect to the circuit's fail-safe characteristics, if the capacitor C1 should short, then there will never be a negative voltage to charge the relay coil K1, and the relay will not operate, resulting in a closed valve. Diode D1 will prevent the positive voltage of the supply from operating the coil K1, when the switch is connected to the positive voltage source.

Additionally, any opening of the capacitor C1 prevents the coil K1 from obtaining any current, and a leaky capacitor C1 just becomes more inefficient until the relay will no longer operate, again resulting in a closed valve.

Should the diode D1 become open, the capacitor C1 would have no charge path except through the relay K1, and thus the average relay current is zero. A shorted diode D1 would prevent any current from flowing through the coil of the relay coil K1. A leaky diode D1 is just inefficient. Thus, a closed valve again would be the result of any of these conditions.

An open or short of the coil of the relay K1, of course, obviates relay operation, likewise resulting in a closed valve.

The gas valve relay driver of the present invention thus achieves failure safety with an absolute minimum of components regardless of what happens to any of the components.

1ST EXEMPLARY SWITCHING CIRCUIT (FIG. 2)

Figure 2:
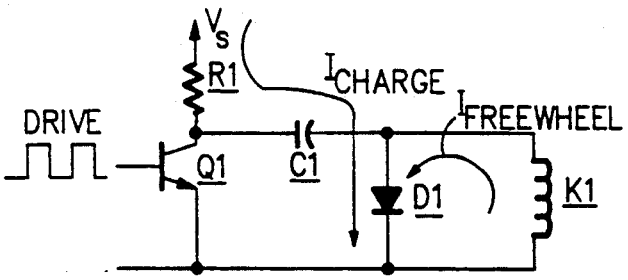
FIG. 2 is a schematic circuit diagram of a first exemplary, embodiment for the essential circuit elements of FIG. 1 of the fail-safe value driver circuit of the present invention, in which a single transistor switch and associated resistor are used as the "switch" for the other driver circuit components.

As can be seen in the circuit diagram of FIG. 2, a single transistor switching means Q1/R1 with a square wave input Drive signal is used for the generalized "switching means" of FIG. 1. As illustrated, the input Drive signal can be supplied across the base and emitter of the transistor Q1, with the resistor R1 connected in series with the collector of the transistor and the high or plus (+) side of the voltage supply $V_s$.

When the transistor Q1 is "off," the capacitor C1 is charged through the resistor R1 and the diode D1. When the transistor Q1 is "on," the capacitor C1 is discharged through the coil of the relay K1.

A "switching" driver signal "Drive", which typically (but not necessarily) would be microprocessor driven and square wave in form, is provided across the base and emitter of the transistor Q1. As is known and common practice in the art, such a signal is a rectified, DC signal based on the burner being "on," and indeed the Drive signal is only present when the burner is "on."

The remainder of the circuit operates in the same manner as described with respect to the generalized circuit of FIG. 1.

2ND EXEMPLARY SWITCHING CIRCUIT (FIG. 3)

Figure 3:
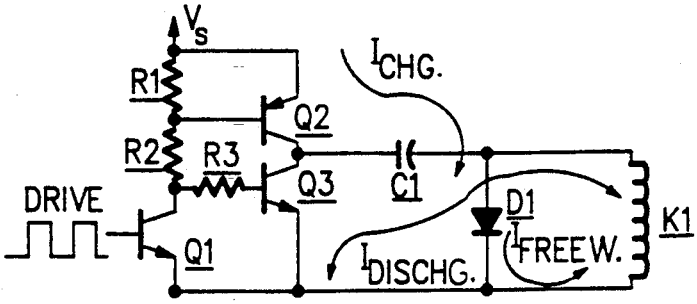
FIG. 3 is a schematic circuit diagram of a second, alternative, exemplary embodiment for the essential circuit elements of FIG. 1 of the fail-safe valve driver circuit of the present invention, in which a set of transistor switches and associated resistors are used as active switching means as the "switch" for the other driver circuit components.

As can be seen in the circuit diagram of FIG. 3, an active transistor switching means Q1/R1–Q3/R3, including a set of three transistors Q1, Q2 & Q3, is used for the generalized "switching means" of FIG. 1.

When transistor Q3 is "off" and transistor Q2 is "on," the capacitor C1 is charged through the diode D1.

When transistor Q3 is "on" and transistor Q2 is "off," the capacitor C1 is discharged through the coil of relay K1 to pull in the relay. Sustaining or free-wheeling wheeling current is maintained when the diode D1 is forward biased during the charge cycle.

As in the embodiment of FIG. 2, a "switching"drive signal "Drive", which typically (but not necessarily) would be microprocessor driven and square wave in form, is provided across the base and emitter of the initial transistor Q1.

The remainder of the circuit likewise, otherwise operates in the same manner as described with respect to the circuit of FIG. 1.

The drive may use an asymmetrical duty cycle to allow lower voltage relay coils to be used in higher supply voltage circuits with very small loss.

It should be understood that the foregoing describes one generalized, exemplary embodiment and two specific, exemplary embodiments of a simplified, highly cost-effective, reliable, "fail-safe" valve relay driver circuit for gas burners in accordance with the principles of the invention. The circuit in its essential elements consists only of an appropriate switching means in series with a capacitive element and the relay coil for the gas valve, with the latter being in parallel with an appropriate unidirectional current device, such as a diode, and that is the totality of the circuit elements for the driver circuit. As noted, the switching means must operate at a sufficiently high rate so that the coil current does not significantly decay during the charging of the capacitive element.

Thus, "fail-safe" operation of the gas valve is achieved without the need of any redundancy.

Exemplary values for the incoming driver signal and the circuit components for the exemplary circuit of FIG. 2 are outlined below:

Drive signal, 400 Hertz providing an "off" tine of about 1.24 millisec.

C1 47 microfarads

D1 any appropriate diode

K1 approx. 500 millihenries 1K ohms

Q1 any appropriate transistor

R1 330 ohms With a voltage supply $V_s$ of twenty-four volts (24V) to ground, this provides an exemplary voltage across the relay coil K1 of ground to minus twelve (−12V) volts. However, it should be understood that these exemplary specifics are subject to great variation.

Although this invention has been shown and described with respect to detailed, exemplary embodiments thereof, it should be understood by those skilled in the art that various changes in components and circuit design may be made without departing from the spirit and scope of this invention.

Having thus described at least one exemplary embodiment of the invention, that which is new and desired to be secured by Letters Patent is claimed below.

I claim:

1. An electrical fail-safe valve drive circuit for a gas valve supplying gas to a gas burner controlling the flow of gas to the burner through the valve, comprising:

switching input drive signal means (S1) in operation supplying a cyclical DC input signal having a frequency and voltage amplitude with respect to a reference point (e.g. "ground");

a capacitive element (C1) and, in series therewith, a valve relay inductance coil (K1) controlling the opening of the valve, said inductance coil being connected between said capacitive element and said reference; said capacitive element being charged up during a portion of the cycle of the input signal and discharging during another portion of the cycle of the input signal, the current in said relay coil being replenished while said capacitive element discharging; and a uni-directional current element (D1) in series with said capacitive element to said reference and in parallel across said inductance coil;

said switching means (S1) being connected across one side of said capacitive element and said reference and one side of said inductance coil; and operating at a sufficiently high rate that the replenished current in said relay coil does not significantly decay during the charging of the capacitive element; said switching means, said capacitive element, said relay coil, and said uni-directional current element being the only operative circuit elements in the fail-safe valve drive circuit.

2. The fail-safe valve driver circuit of claim 1, wherein:

said uni-directional current element is a diode.

3. The fail-safe valve drive circuit of claim 1, wherein said switching means includes:

a voltage supply ($V_2$) and a square wave input signal (Drive) and at least one transistor (Q1) whose emitter is connected to said reference, said input signal being supplied across said transistor's emitter and base; and a resistor connector in series with said transistor's collector and the other side of said voltage supply.

4. The fail-safe valve driver circuit of claim 3, wherein said switching means includes:

an active transistor switching section including at least three, ganged transistors (Q1, Q2 & Q3).

5. A method of driving an electrically controlled gas valve supplying gas to a gas burner controlling the flow of gas to the burner through the valve in a fail-safe manner, through a driver circuit including switching input drive signal means (S1) in operation supplying a cyclical DC input signal having a frequency and voltage amplitude with respect to a reference pint (e.g. "ground");

a capacitive element (C1) and, in series therewith, a valve relay inductance coil (K1) controlling the opening of the valve, said inductance coil being connected between said capacitive element and said reference; and a uni-directional current element (D1) in series with said capacitive element to said reference, and in parallel across said inductance coil;

comprising the following steps:

(a) charging said capacitive element during a portion of the cycle of the input signal and discharging it during another portion of the cycle of the input signal;

(b) replenishing the current in said relay coil while said capacitive element is discharging;

(c) operating the switching means at a sufficiently high rate that the replenished current in said relay coil does not significantly decay during the charging of the capacitive element; and (d) utilizing only said switching means, said capacitive element, said relay coil and said uni-directional current element as the total operative elements in said driver circuit.

6. The method of claim 5, wherein there is included the step of:

utilizing said uni-directional current element to sustain the current in said relay coil when said capacitor element in a cyclical manner is again being charged up.

* * * * *

UNITED STATES PATENT AND TRADEMARK OFFICE

CERTIFICATE OF CORRECTION

PATENT NO. : 5,085,574

DATED : February 4, 1992

INVENTOR(S) : LARRY E. WILSON

It is certified that error appears in the above-identified patent and that said Letters Patent is hereby corrected as shown below:

Column 2, line 5: "Pat. No. 4,872,826" should read --Pat No. 4,872,828--.

Column 3, line 2: "relay pulling" should read --(relay pulling)--.

Claim 5, column 6, line 31: "pint" should read --point--.

Signed and Sealed this

First Day of June, 1993

*Attest:*

Michael K. Kirk

MICHAEL K. KIRK

*Attesting Officer*

*Acting Commissioner of Patents and Trademarks*